US007335141B2

(12) United States Patent
Piane, Jr.

(10) Patent No.: US 7,335,141 B2
(45) Date of Patent: Feb. 26, 2008

(54) EXERCISE APPARATUS

(75) Inventor: Robert A. Piane, Jr., Newark, DE (US)

(73) Assignee: BVP Holding, Inc., Newark, DE (US)

( * ) Notice: Subject to any disclaimer, the term of this patent is extended or adjusted under 35 U.S.C. 154(b) by 0 days.

(21) Appl. No.: 11/408,213

(22) Filed: Apr. 20, 2006

(65) Prior Publication Data

US 2006/0240956 A1 Oct. 26, 2006

Related U.S. Application Data

(60) Provisional application No. 60/673,524, filed on Apr. 21, 2005.

(51) Int. Cl.
*A63B 21/062* (2006.01)
*A63B 21/00* (2006.01)

(52) U.S. Cl. ..... 482/99; 482/101; 482/138

(58) Field of Classification Search ..... 482/94, 482/99, 100, 103, 138, 101
See application file for complete search history.

(56) References Cited

U.S. PATENT DOCUMENTS 5,018,725 A * 5/1991 Cook ..... 482/103
5,102,122 A * 4/1992 Piane et al. ..... 482/133
5,413,546 A * 5/1995 Basile ..... 482/99
5,928,117 A * 7/1999 Vittone et al. ..... 482/99
6,102,836 A * 8/2000 Person ..... 482/103
6,165,110 A * 12/2000 Gajda ..... 482/102
6,371,895 B1 * 4/2002 Endelman et al. ..... 482/135
6,458,061 B2 * 10/2002 Simonson ..... 482/103
6,607,472 B2 * 8/2003 Toole ..... 482/123
6,685,600 B1 * 2/2004 Ullman ..... 482/103
6,689,023 B2 * 2/2004 Baumler ..... 482/100
6,705,976 B1 3/2004 Piane, Jr.

* cited by examiner

*Primary Examiner*—Fenn C. Mathew
*Assistant Examiner*—Allana Lewin
(74) *Attorney, Agent, or Firm*—Milde & Hoffberg, LLP

(57) ABSTRACT

Exercise apparatus is disclosed which enables a user to pull a cable against a source of resistance from a pulley arranged at one of a number of points around a substantially circular arc. The exercise apparatus includes: an arcuate frame member forming a segment of an approximate circle having a center, the circle with its center lying in an imaginary plane; (b) a frame support for supporting the frame member in a upright position such that the plane is substantially vertically oriented; (c) a first cable pulley adapted to be attached to the frame member at one of a plurality of positions along the arc; (d) a second cable pulley fixedly mounted in the vicinity of a substantially horizontal, imaginary first axis that extends perpendicular to the plane and passes through the center of the circle; (e) at least one source of resistance; (f) a handle adapted to be grasped by a user; and (g) a flexible cable having a proximate end attached to said handle and a distal end coupled to said at least one resistance source, the cable passing through both the first pulley and the second pulley.

25 Claims, 15 Drawing Sheets

EXERCISE APPARATUS

CROSS-REFERENCE OF RELATED APPLICATION

This application claims priority from Provisional Patent Application No. 60/673,524 filed Apr. 21, 2005, and entitled "EXERCISE APPARATUS".

BACKGROUND OF THE INVENTION

The present invention relates to exercise apparatus of the type which allows a user to repeatedly pull on a handle which is attached to a cable. A source of resistance, such as one or more weights, springs, elastic bands, and/or hydraulic or pneumatic dampers, is coupled to a distal end of the cable to counteract the tension applied to the cable by the user.

Exercise apparatus of this type is well known. It is also known to design such exercise apparatus so that the cable portion leading to the handle emanates from a cable pulley at a selected exit point along a circular arc formed by an arcuate frame member of the machine. This exit point may be determined by the position of a trolley that supports the cable pulley. This trolley can be moved along an arcuate track that follows the arcuate frame member and is secured in a fixed position along this track to adjust the cable exit point. Alternatively, the pulley may be attached directly by hand to fittings on the arcuate frame member, which are located at a number of fixed points along the arc.

Exercise equipment of this type is disclosed in the U.S. Pat. Nos. 5,102,122 and 6,705,976 to Piane and the U.S. Pat. No. 6,685,600 to Ullman. The disclosures of these three U.S. patents are incorporated herein by reference.

In the above-noted patents to Piane, the trolley track, which extends along the circular frame member, is permanently fixed in position on the exercise apparatus and cable take-up means are provided to compensate for the different cable lengths required as the trolley is moved from position to position along the track. The apparatus can be designed to provide either one arcuate trolley track, or two tracks arranged in opposition, allowing the user to select cable exit points from any position around a substantially complete circle.

In the above-noted patent to Ullman, two semi-circular trolley tracks are provided in the apparatus, connected together at both top and bottom in a hinged manner. While this arrangement allows the positions of the trolley tracks to be moved laterally (horizontally) about the hinged connection points, thus providing additional flexibility to the user, this apparatus has no cable take-up mechanism and therefore cannot compensate for a change the length of the cable when the position one of the trolleys along its track is changed. Also, because the two semi-circular trolley tracks are hinged together, top and bottom, it is difficult for a person to stand in the center region while using the apparatus.

SUMMARY OF THE INVENTION

A principal object of the present invention is to provide exercise apparatus of the type described above which allows the cable exit point to be changed from one position to another along a semi-circular arc without requiring a separate cable take-up mechanism to adjust the length of the cable.

It is a further object of the present invention to provide exercise apparatus of the type described above which provides two, opposed semi-circular frame members that carry either a trolley track or a plurality of fittings to establish a plurality of cable exit points, and that may be adjusted in their separation to allow a user to either sit or stand between them and to facilitate the user's freedom of movement, permitting him/her to assume various training positions, particularly while standing, thus to carry out an almost unlimited variety of exercises.

These objects, as well as further objects which will become apparent from the discussion that follows, are achieved, in accordance with the present invention, by providing exercise apparatus comprising the following combination of elements:

(a) an arcuate frame member forming a segment of an approximate circle having a center, the circle with its center lying in an imaginary plane;

(b) frame support for supporting the frame member in a upright position such that the plane is substantially vertically oriented;

(c) a first cable pulley adapted to be attached to the frame member at one of a plurality of positions along the arc;

(d) a second cable pulley fixedly mounted in the vicinity of a substantially horizontal, imaginary first axis that extends perpendicular to the plane and passes through the center of the circle;

(e) at least one source of resistance;

(f) a handle adapted to be grasped by a user; and (g) a flexible cable having a proximate end attached to said handle and a distal end coupled to said at least one resistance source, the cable passing through both the first pulley and the second pulley.

This arrangement avoids the necessity of providing a cable take-up mechanism to adjust the length of the cable as the exit point of the cable, prescribed by the position of the first pulley, is moved from one position to another along the arcuate frame member. This is because the distance between the first cable pulley, which is adjacent the arcuate frame member, and the second cable pulley, disposed adjacent the imaginary axis, always remains approximately constant, independent of the position of the first pulley.

The arcuate frame member preferably defines a segment, (from 90° to 180°) of a circle. It is not necessary, however, for the frame member to be exactly circular in shape. Rather, the frame member may be simply arcuate and form a segment of an "approximate" circle.

The exercise apparatus may comprise a single arcuate frame member; however, the apparatus preferably comprises two arcuate frame members arranged in opposition, to form an approximate circle.

The arcuate frame member(s) may be provided with a plurality of fittings along its length to permit attachment of the first cable pulley at a number of selected points. Alternatively, the arcuate frame member may be provided with a trolley that supports the first cable pulley. This trolley may be moved by the user along a track on the arcuate frame member and fixed in position at a selected point.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
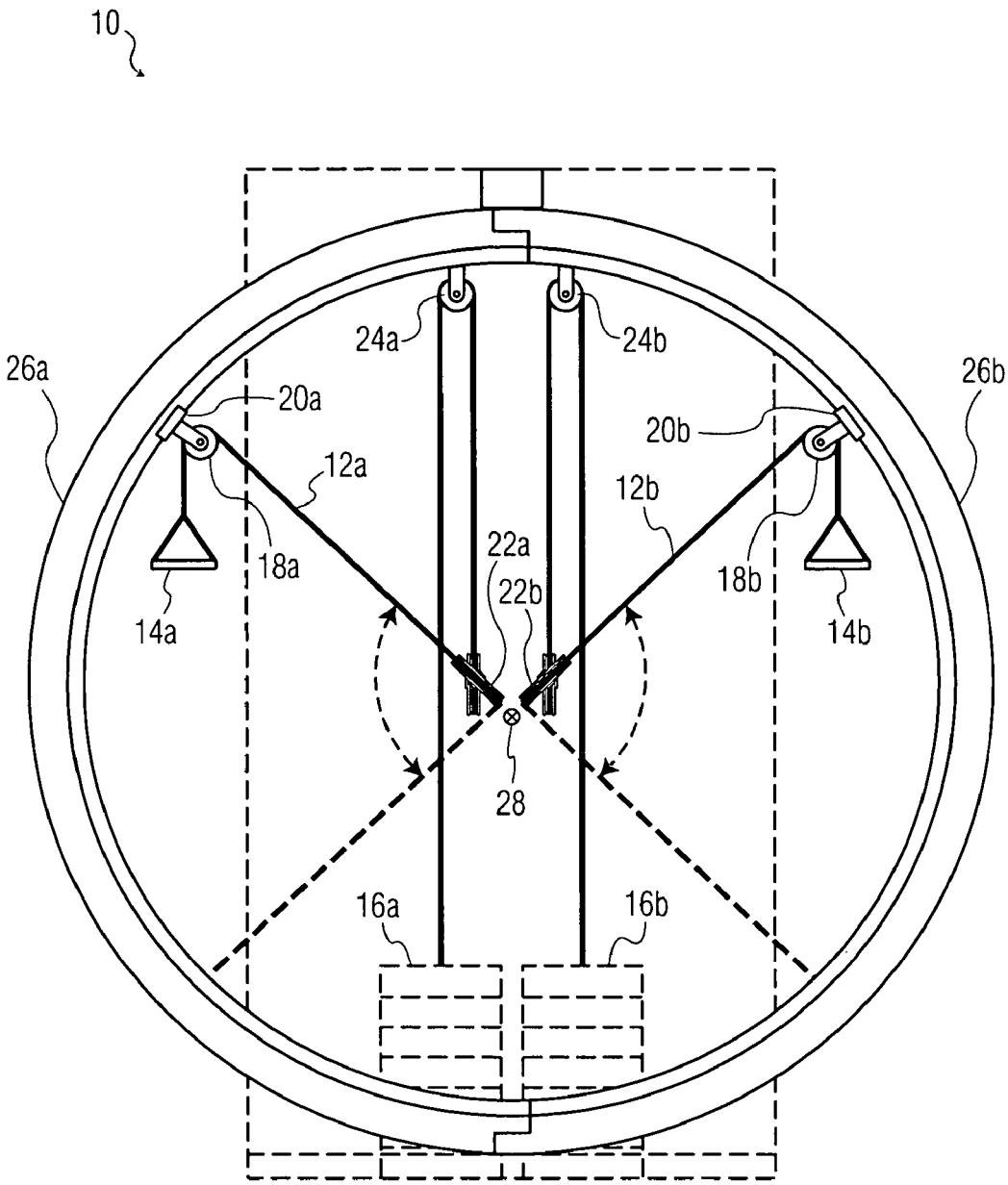
FIG. 1 is a front view of exercise apparatus according to a first preferred embodiment of the present invention.

The preferred embodiments of the present invention will now be described with reference to FIGS. 1-12 of the drawings. Identical elements in the various figures are designated with the same reference numerals.

FIGS. 1-4 illustrate a first preferred embodiment of exercise apparatus according to the present invention, generally designated by the reference numeral 10. This apparatus has two cables 12*a* and 12*b* each having a proximate end and a distal end. The proximate end of each cable is connected to a handle 14*a*, 14*b*, respectively, designed to be pulled by a user. The distal end of each cable 12*a*, 12*b* is coupled to a source of resistance such as a weight stack 16*a*, 16*b*, respectively. The source of resistance can also be a spring, which may be realized by an elastic band, or a hydraulic or pneumatic damper; e.g., a piston in a cylinder. The source of resistance can also be a combination of one or more weights, springs and dampers, as desired.

Between their proximate and distal ends, the cables 12*a*, 12*b*, respectively, pass through at least three pulleys: a first pulley 18*a*, 18*b* arranged on a trolley or slide arrangement 20*a*, 20*b*; a central second pulley 22*a*, 22*b*, and an upper third pulley 24*a*, 24*b* mounted on a frame above the respective resistance source 16*a*, 16*b*.

The trolley or slide 20*a*, 20*b* (hereinafter designated simply the "trolley") is moveable along an arcuate frame member 26*a*, 26*b*, respectively, and positionable at a plurality of locations along this frame member. Each frame member 26*a*, 26*b* forms an approxiate segment of a circle, as is best illustrated in FIG. 1. This circle, with its center point 28, lies in an imaginary, substantially vertical plane defined by the arc segments.

The central pulleys 22*a*, 22*b* are fixedly mounted adjacent each other in the vicinity of a substantially horizontal, imaginary axis 30 that extends perpendicular to the plane of the circle, defined by the arcuate frame members, and passes through the center point 28. With this arrangement, the trolleys 20*a*, 20*b* can be moved to any point along their arcuate frame members 26*a*, 26*b* without adjusting the lengths of the respective cables 12*a*, 12*b*. As the trolleys 20*a*, 20*b* are moved, the lengths of the cables between their proximate ends at handles 14*a*, 14*b* and the portions which pass around the pulleys 18*a*, 18*b* remain substantially constant.

Figure 2:
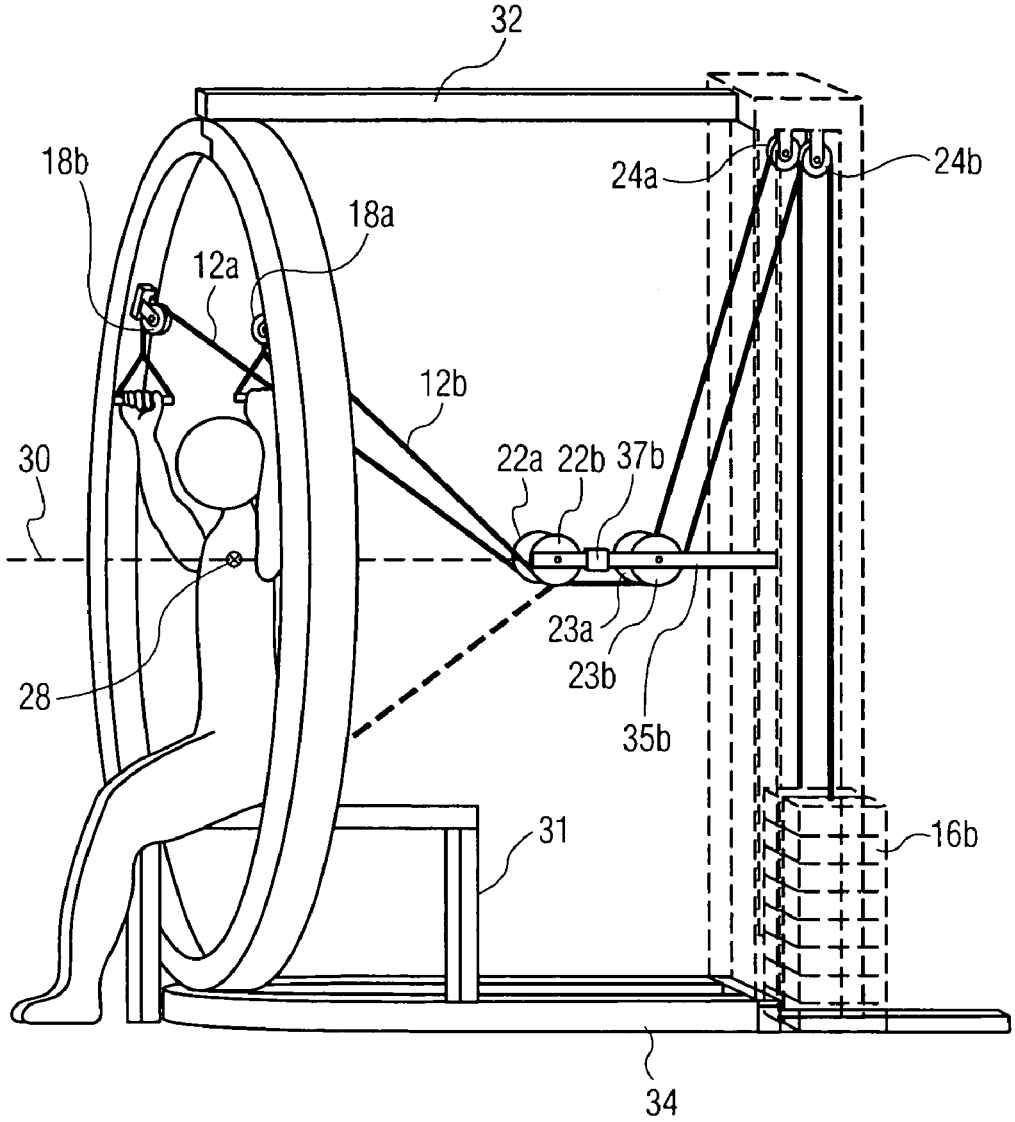
FIG. 2 is a side view of the exercise apparatus of FIG. 1.
Figure 3:
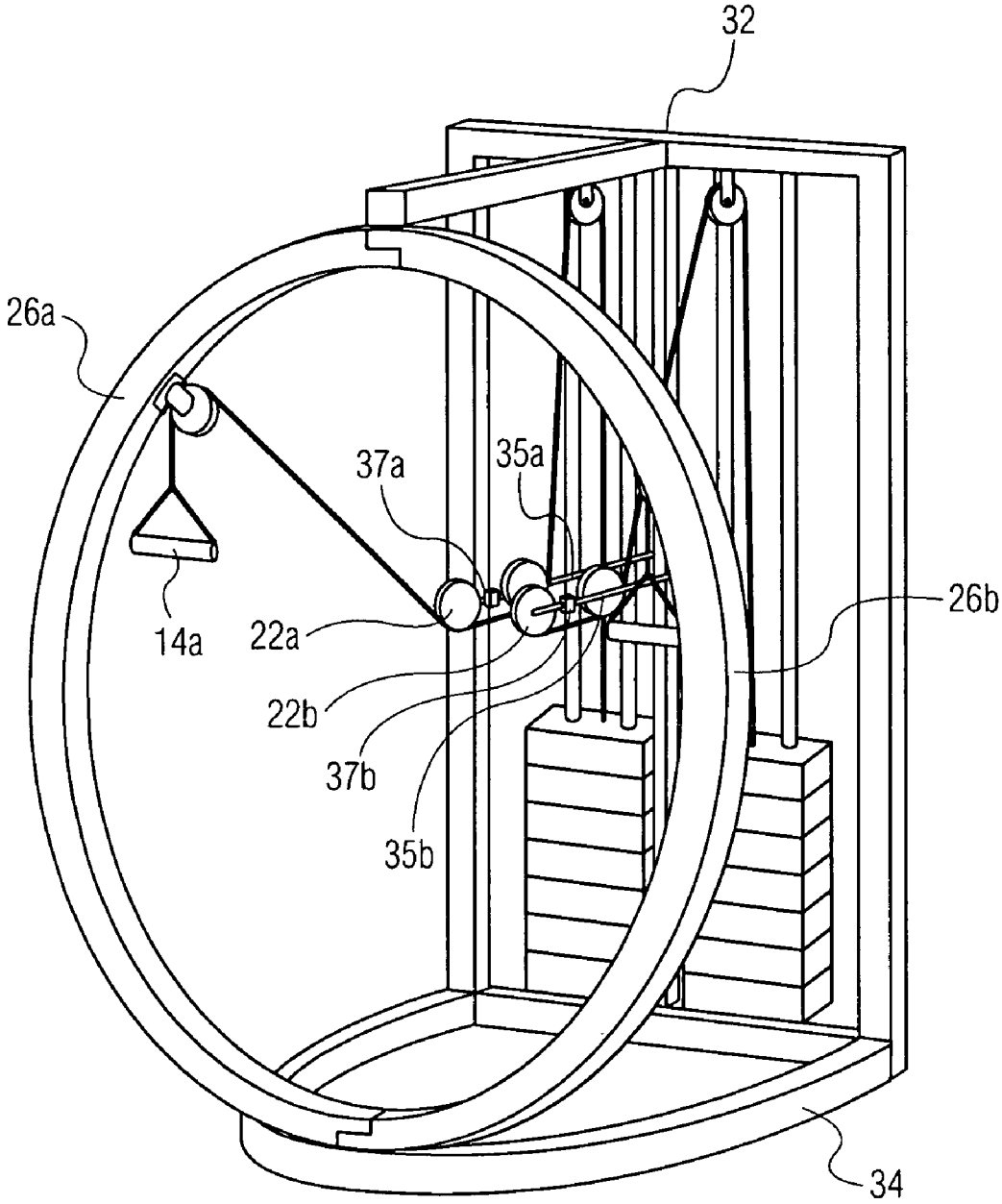
FIG. 3 is a perspective view of the exercise apparatus of FIG. 1.

The frame members 26*a*, 26*b* are affixed to a supporting frame element 32 at their topmost points and to a base frame 34 at the bottom, as shown in FIGS. 2 and 3. The user may either stand in front of the arcuate frame members to repeatedly pull on the handles 14*a*, 14*b* or, as shown in FIG. 2, may sit on a bench 31 between the frame members in the vicinity of the center point 28.

The central pulleys 22*a* and 22*b* are each mounted to the frame of the exercise apparatus via a suitable bracket 35*a*, 35*b*, respectively. The pulleys 22*a*, 22*b* are mounted to the bracket via a gimbal 37*a*, 37*b* that allows each pulley to rotate about an axis parallel to the central axis 30. As indicated in FIG. 1, it is desirable to allow the pulleys 22*a*, 22*b* to self align with the cables 12*a*, 12*b* as the trolleys 12*a*, 12*b* are moved from one position to the next along the frame members 26*a*, 26*b*.

As is best illustrated in FIG. 2, two additional pulleys 23*a*, 23*b* are also mounted for rotation on the bracket 35*a*, 35*b*, respectively. These additional pulleys guide the cable between the gimbaled pulleys 22*a*, 22*b* and the upper pulleys 24*a*, 24*b*, respectively.

Figure 4:
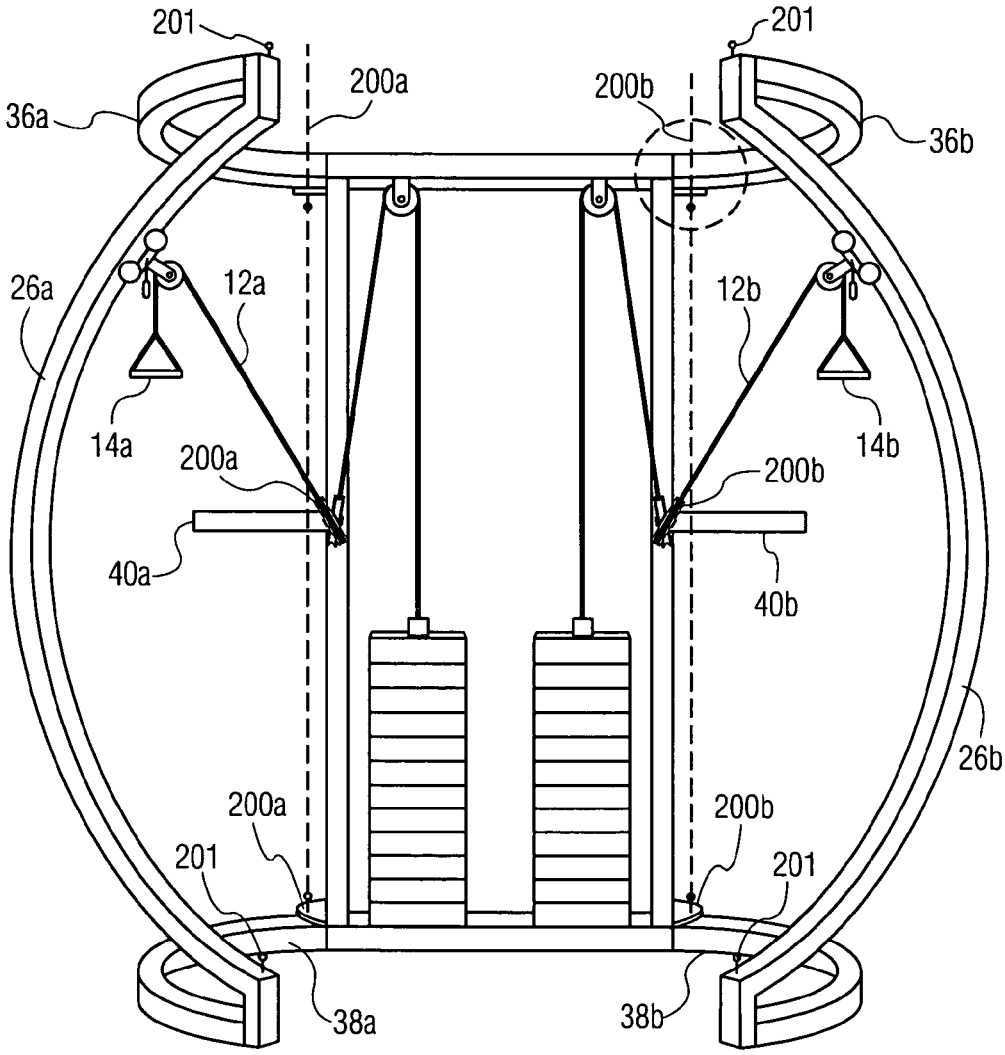
FIG. 4 is a front view of exercise apparatus according to a second preferred embodiment of the present invention.
Figure 4A:
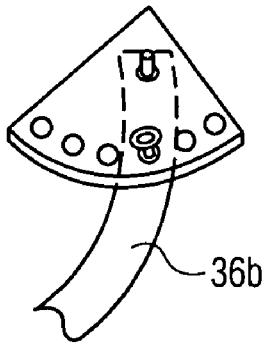
FIGS. 4A, 4B and 4C are detailed views of a pinned hinge used for support arms in the exercise apparatus of FIG. 4.
Figure 4B:
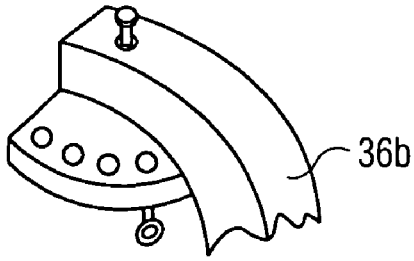
Figure 4C:
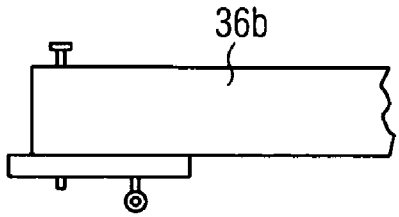
Figure 5A:
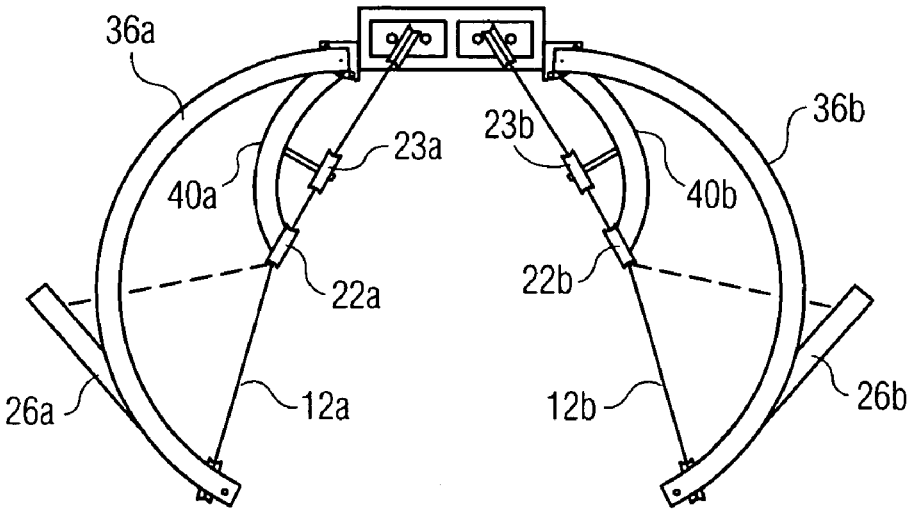
FIGS. 5A and 5B are top views of the exercise apparatus of FIG. 4 with the arcuate frame members arranged in two different positions, respectively, showing the different positions of the pulleys.
Figure 5B:
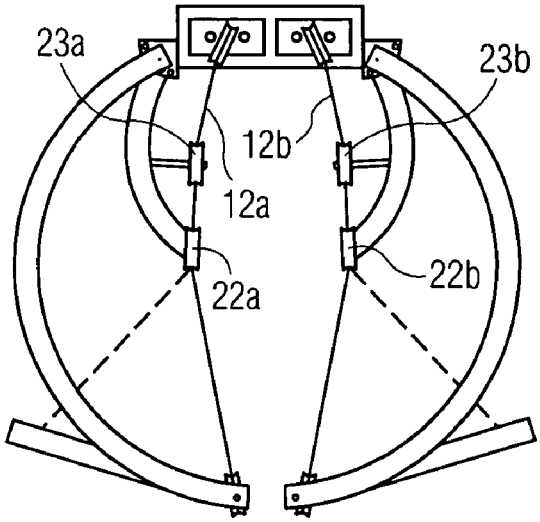
Figure 6:
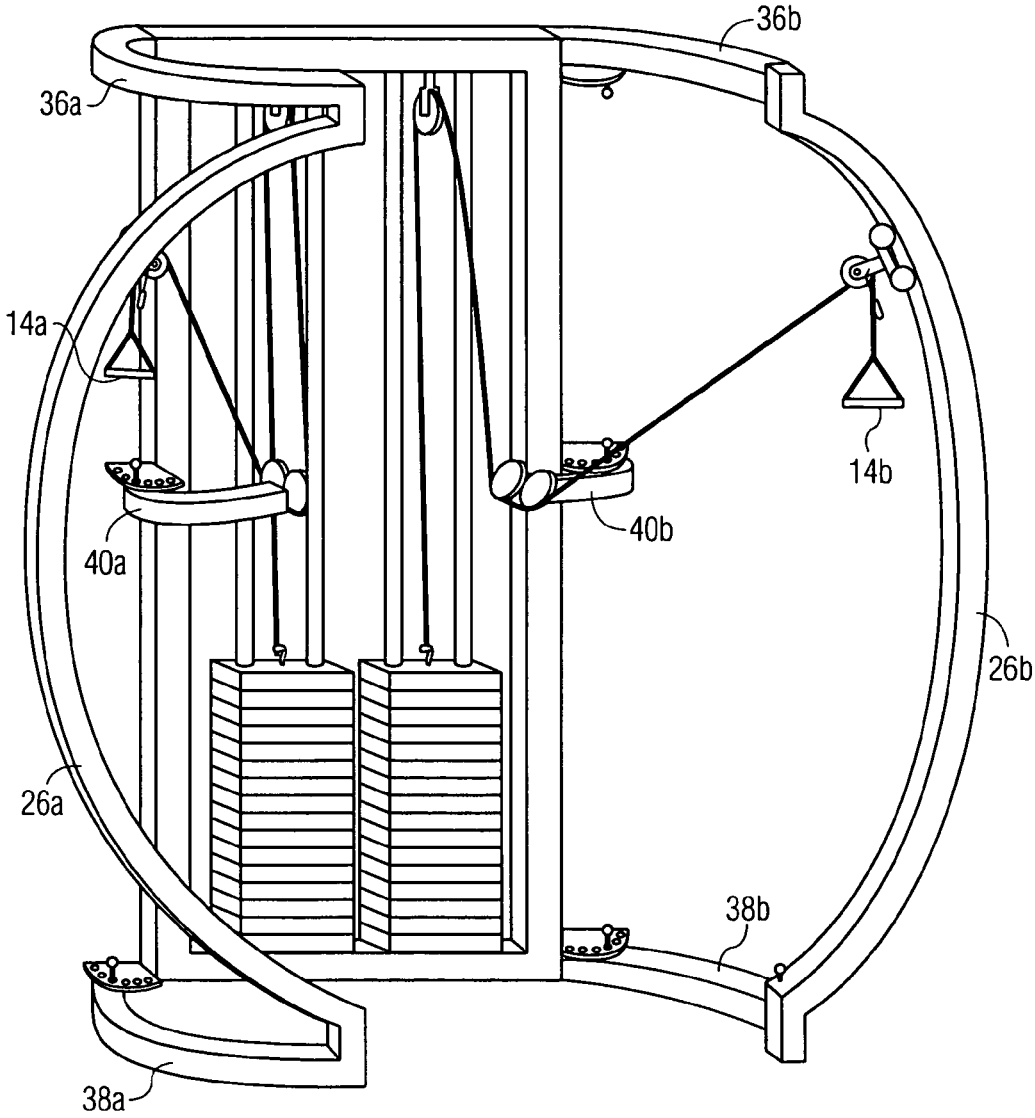
FIG. 6 is a perspective view of the exercise apparatus of FIG. 4.

FIGS. 4-6 illustrate a second preferred embodiment of the present invention which allows the user to stand in the region between the frame members 26*a*, 26*b*. In this embodiment the frame members are held, top and bottom, by upper support arms 36*a*, 36*b*, respectively, and lower support arms 38*a*, 38*b*, respectively. The support arms are hinged and pivotable about pivot axes 200*a*, 200*b*, to allow the frame members 26*a*, 26*b* to be moved apart or closer together, and also to be supported when set at a desired position. The positions are selectable by means of "pop pins" that may be inserted in one of a number of holes to lock the support arms in place, top and bottom. Three views of the selectorized positioning system are shown in FIGS. 4A, 4B and 4C, respectively.

FIGS. 5A and 5B show two different, selected positions of the support arms and arcuate frame members, respectively. These diagrams also illustrate how the central pulleys 22*a*, 22*b* and 23*a*, 23*b* are moved together with the support arms 36*a*, 36*b* and 38*a*, 38*b* so that the cables 12*a*, 12*b* may be maintained at a constant length. In this embodiment, the pulley sets 22*a*, 22*b* and 23*a*, 23*b* are mounted on separate support arms 40*a*, 40*b*, respectively, which move together with the support arms 36*a*, 36*b* and 38*a*, 38*b* to maintain the constant cable length.

Figure 7:
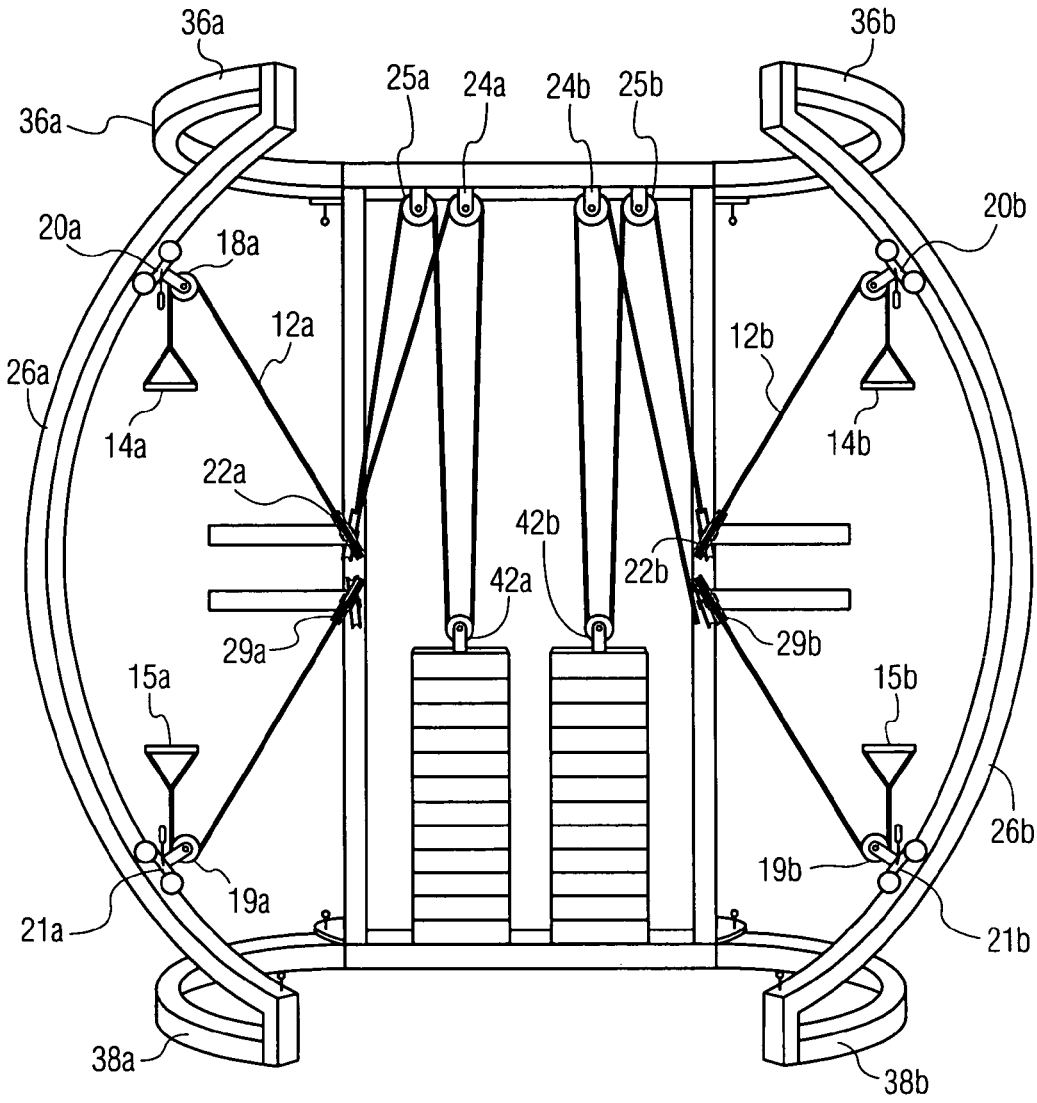
FIG. 7 is a front view of exercise apparatus according to a third preferred embodiment of the present invention, similar that of the embodiment shown in FIGS. 4-6.

FIG. 7 illustrates still another preferred embodiment of the present invention, similar to that of FIGS. 5-6, which incorporates two sets of trolleys 20*a*, 21*a* and 20*b*, 21*b* on each arcuate frame member 26*a*, 26*b*, respectively. The trolleys 20*a*, 21*a* and 20*b*, 21*b* are each provided with a pulley 18*a*, 19*a* and 18*b*, 19*b*, respectively, as shown in FIG. 7. In this case, a single cable, 12*a* or 12*b*, is passed from handles 14*a*, 14*b* through one set of the trolley pulleys 20*a*, 20*b*; then through the central set of pulleys 22*a*, 22*b* and 23*a*, 23*b*; then a third set of pulleys 24*a*, 24*b* at the top of the frame; then a fourth set of pulleys 42*a*, 42*b* at the resistance source; then back to another set of pulleys 25*a*, 25*b* at the top of the frame; then back to a second set of pulleys 27*a*, 27*b* and 29*a*, 29*b* at the center region; and finally through the pulleys 19*a*, 19*b* that are mounted on the second set of trolleys 21*a*, 21*b*, to the handles 15*a*, 15*b*.

The exercise apparatus shown in FIG. 7 allows a user to pull on handles 14*a*, 14*b* or handles 15*a*, 15*b*, as desired.

It will be understood that wherever the term "trolley" is used in the description of the present invention, it is intended to incorporate any manner or means for moving and holding a pulley 18*a*, 18*b* in a selected position along the arcuate frame member 26*a*, 26*b*. This "trolley" may consist of a simple slide, of the type disclosed in the U.S. Pat. No. 6,685,600. However, to avoid problems of providing lubrication or other means to enhance slippage of a slide, the device preferably includes one or more trolley wheels arranged to travel in a track. In order to hold the wheels, the track must comprise both top and bottom portions for supporting opposite sides of the trolley wheels.

One advantageous arrangement, which could include merely one or two wheels, comprises a wheel and track configuration such as is commonly used to support the opposite sides of a garage door. In this case, the "garage door" of each track would be formed in a semi-circular shape and attached to an arcuate frame member 26*a*, 26*b*.

FIGS. 8A, 8B, 8C and FIG. 9 illustrate a preferred embodiment of a trolley which may be used with any one of the preferred embodiments described above or with any other type of exercise apparatus having a curved (or straight) frame member or track to position a cable pulley in a plurality of selected positions.

Figure 8A:
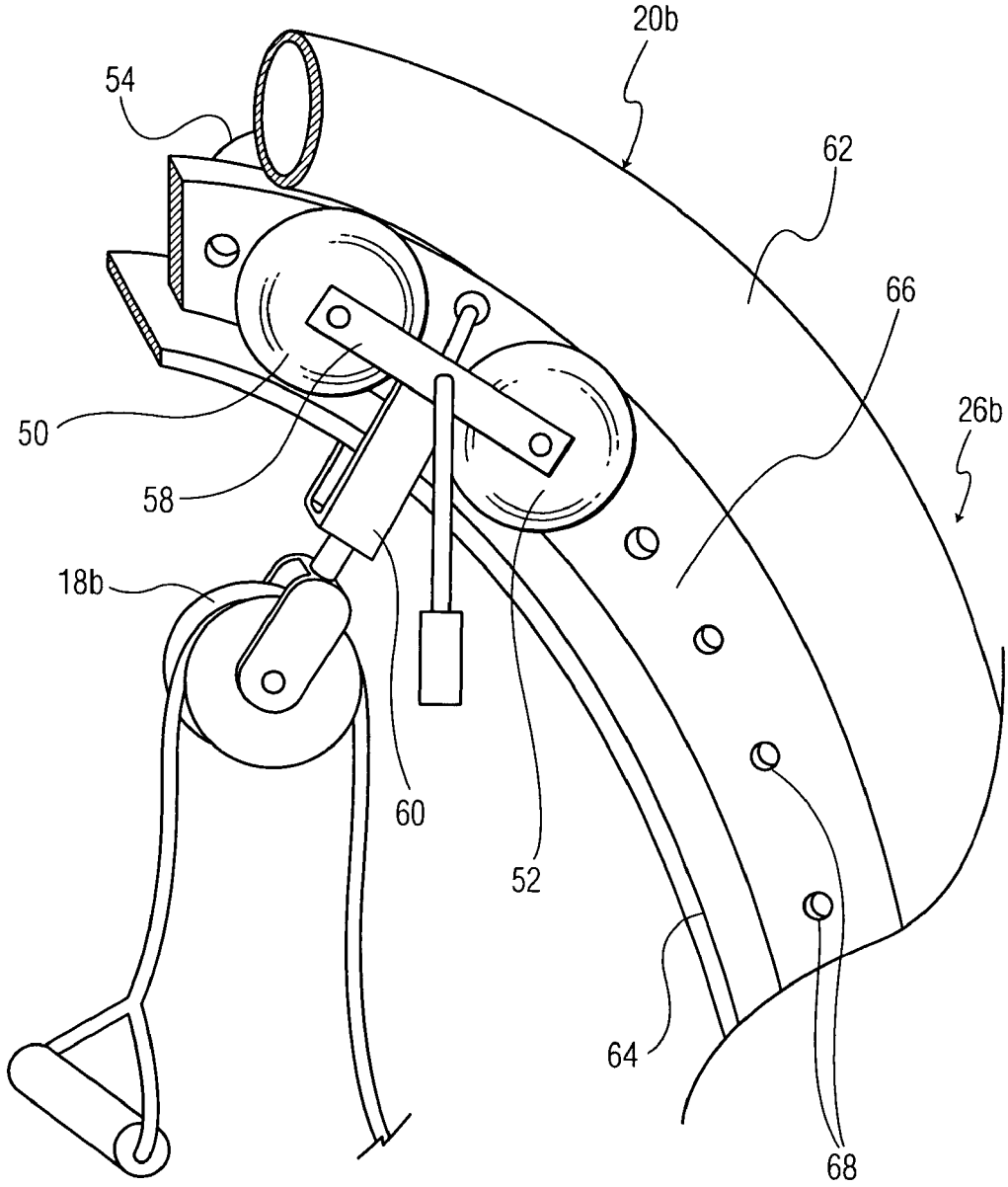
FIGS. 8A, 8B and 8C are detailed perspective views of a trolley arrangement which may be used in exercise apparatus according to the invention.
Figure 8B:
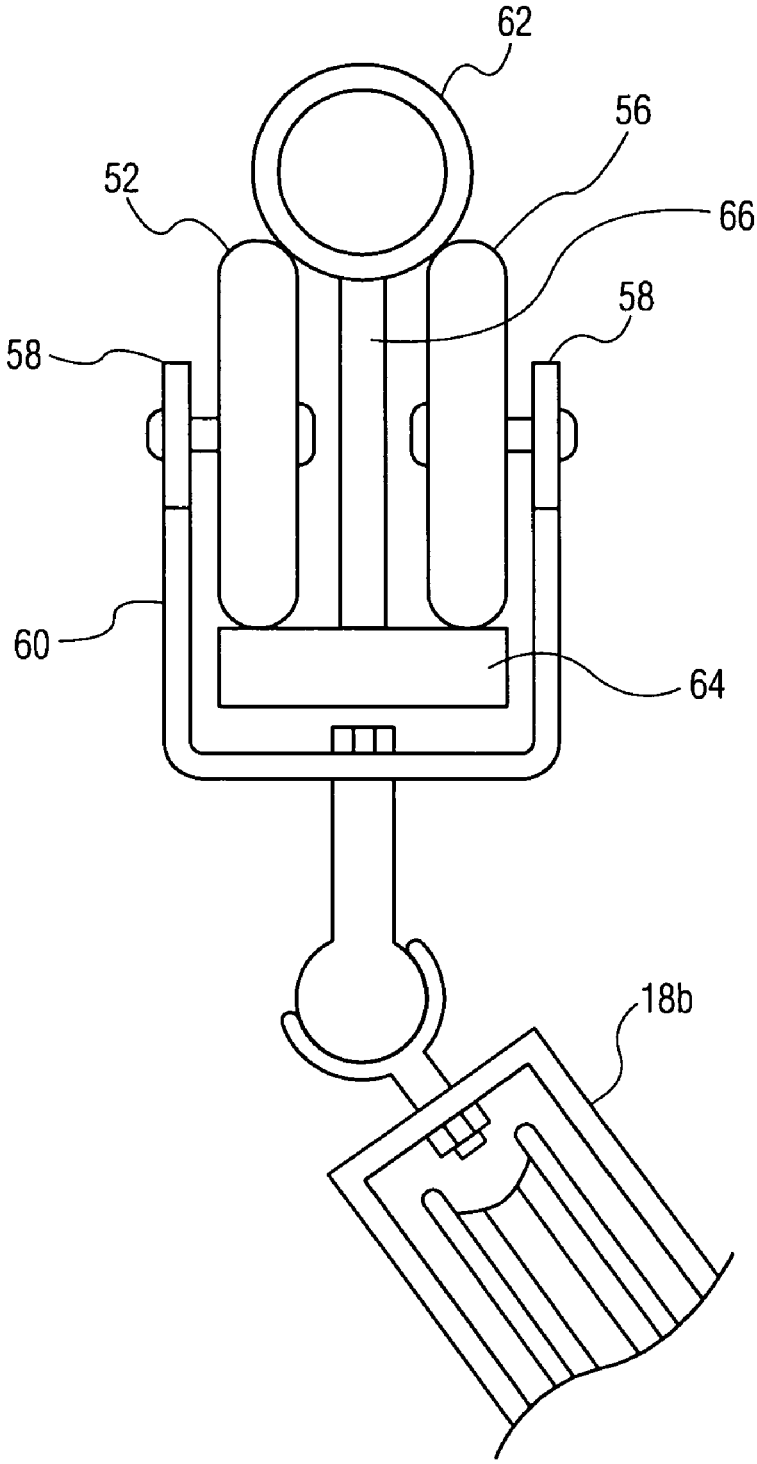
Figure 8C:
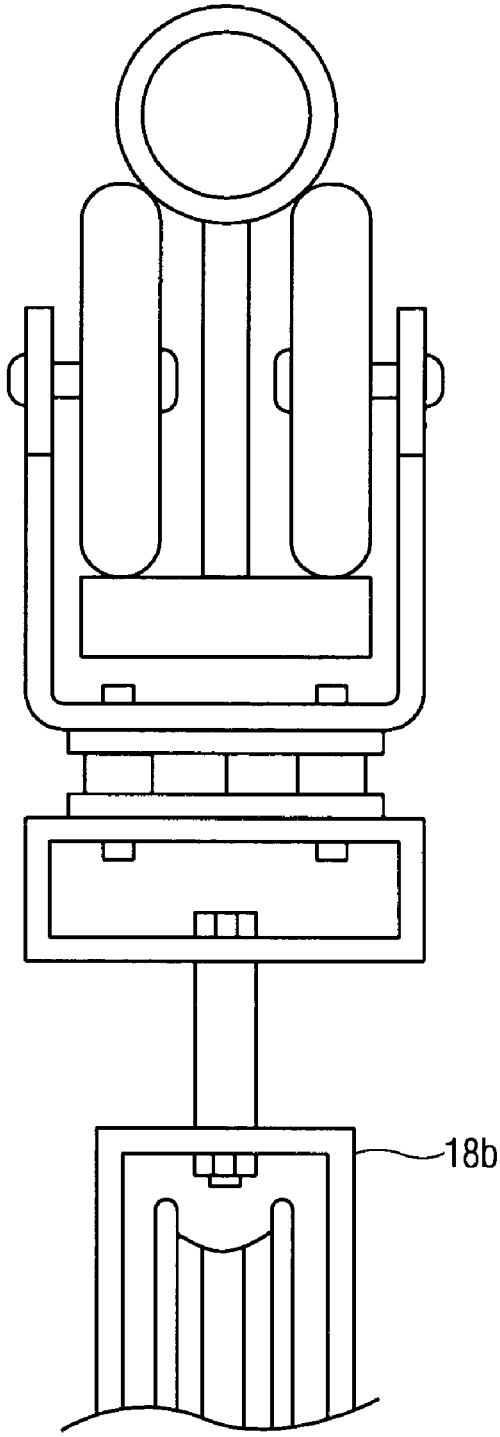

In this preferred embodiment the trolley comprises four wheels 50, 52, 54, 56 arranged on a frame 58 with means 60 for holding the pulley 18*b*. The means 60 may hold the pulley 18*b* in any convenient manner which allows the pulley to swivel. Two preferred mechanisms are illustrated in FIGS. 8B and 8C, respectively.

The track forming the frame member 26*b* comprises a tube 62 and a base rail 64, interconnected by a beam 66, for supporting the trolley wheels top and bottom.

Figure 9:
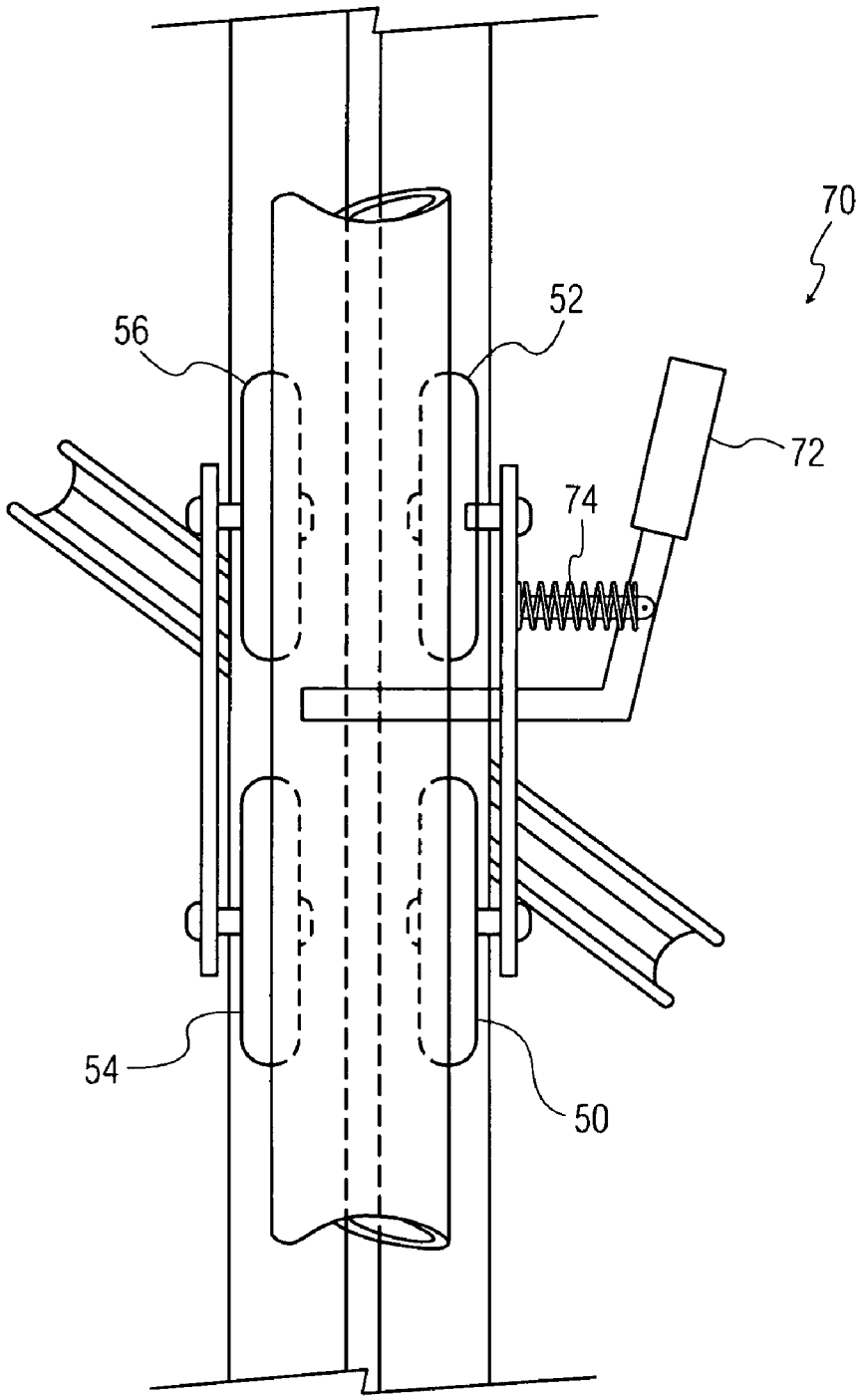
FIG. 9 is a top view of the trolley arrangement of FIG. 8, showing the locking mechanism in detail.

The beam 66 is provided with a plurality of recesses or holes 68 to permit the trolley 20*b* to be locked into position. The locking mechanism 70, which is best illustrated in FIG. 9, comprises a handle 72 that is biased toward the locked position by a spring 74. The locking mechanism 70 thus forms a detent mechanism for insertion into the recesses (holes) 68 along the track. The handle 72 allows the user to withdraw the detent mechanism from one of the recesses so that the trolley may be moved to another position.

Figure 10:
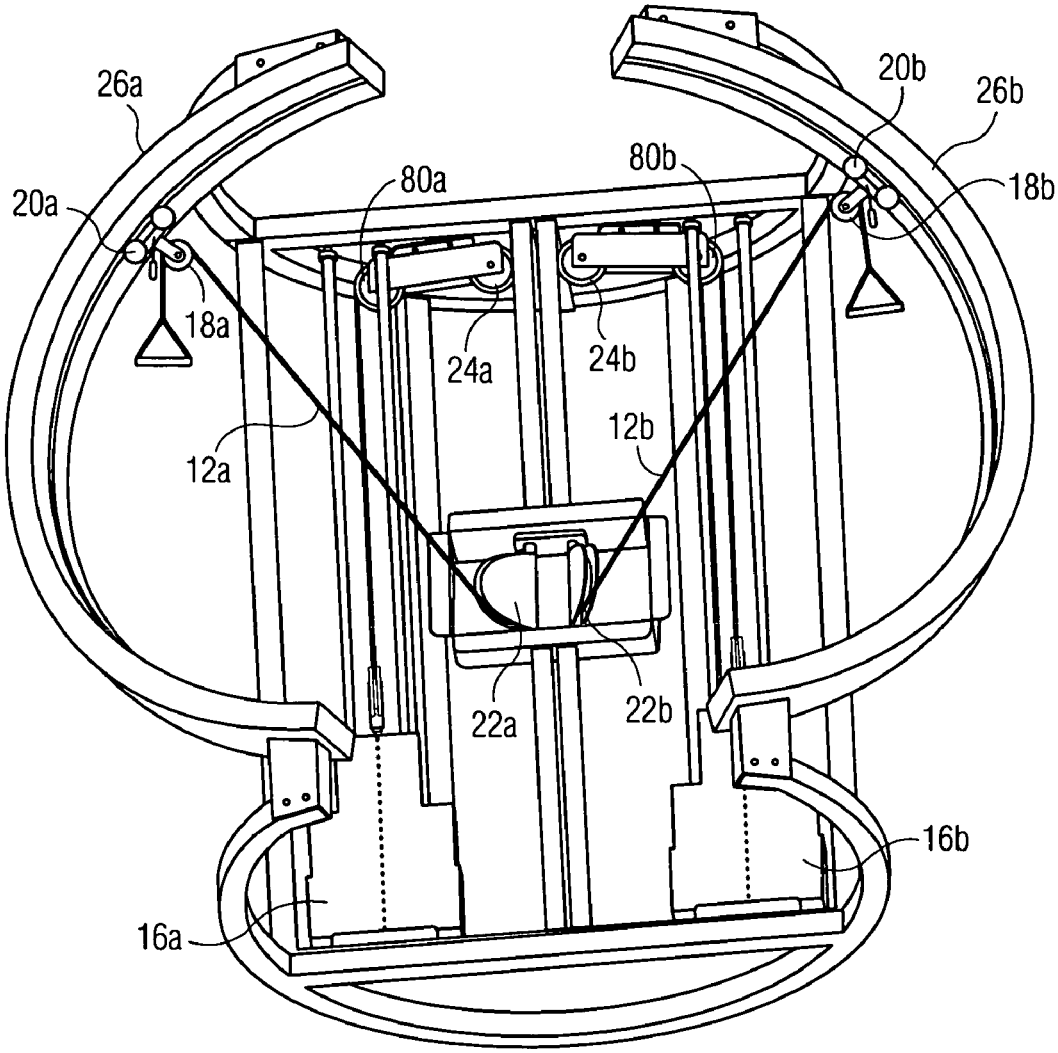
FIG. 10 is a perspective view, viewed from below, of exercise apparatus according to a fourth preferred embodiment of the present invention.
Figure 11:
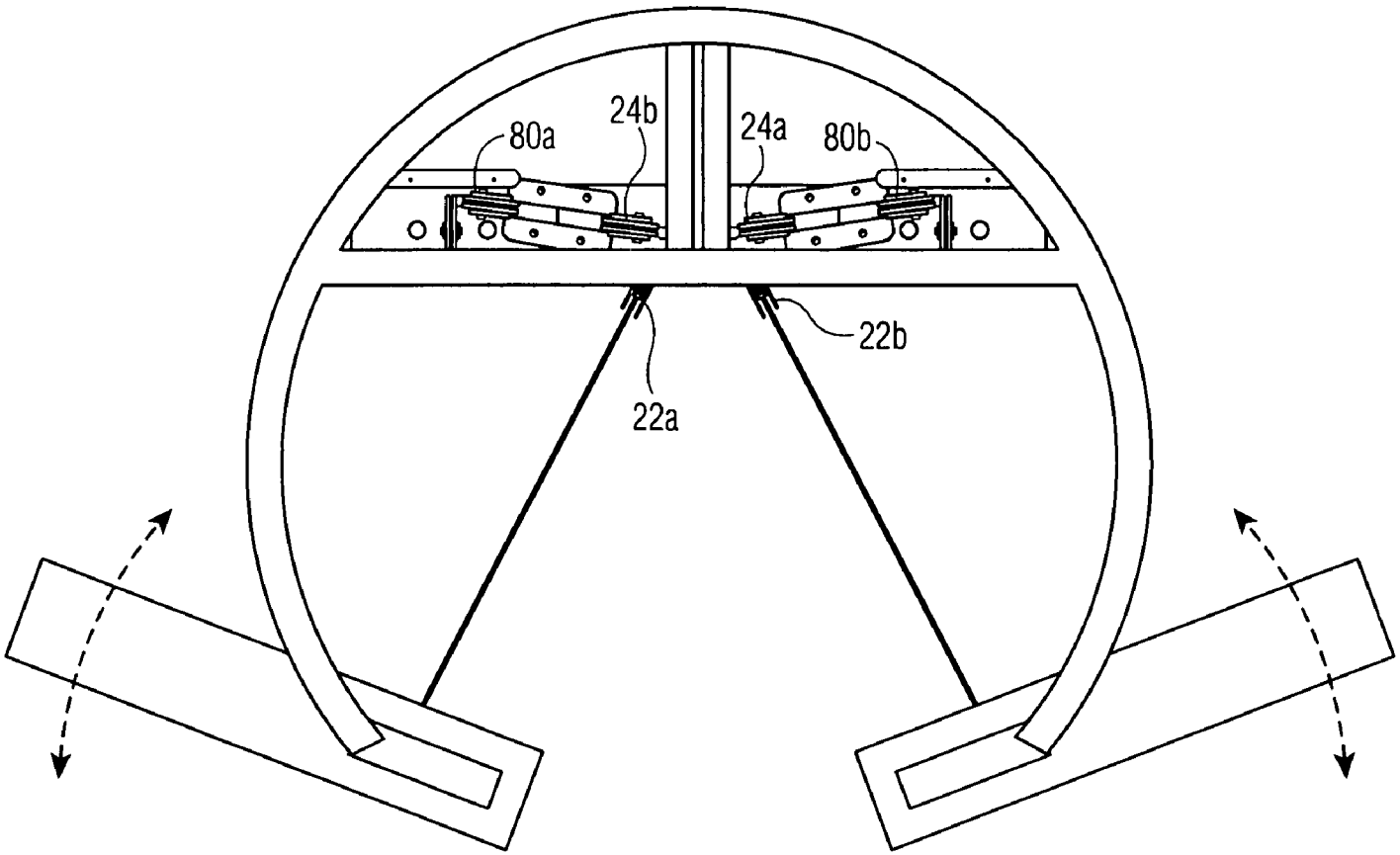
FIG. 11 is a top view of the exercise apparatus of FIG. 10.

FIGS. 10 and 11 show a third embodiment in which the frame members 26*a* and 26*b* are hinged, top and bottom, for movement about a respective vertical axis and wherein the pulleys 18*a* and 18*b* are supported by a slide which runs in a slot. In this case, the cables 12*a* and 12*b* are passed around a single central pulley 22*a*, 22*b*, respectively, which is mounted for rotation and gimbaled about a vertical axis (FIG. 10). The cable is then brought vertically to upper pulleys 24*a*, 24*b* and outward to pulleys 80*a* and 80*b* before descending downward to the respective resistance source (weight stack) 16*a* and 16*b*.

Figure 12:
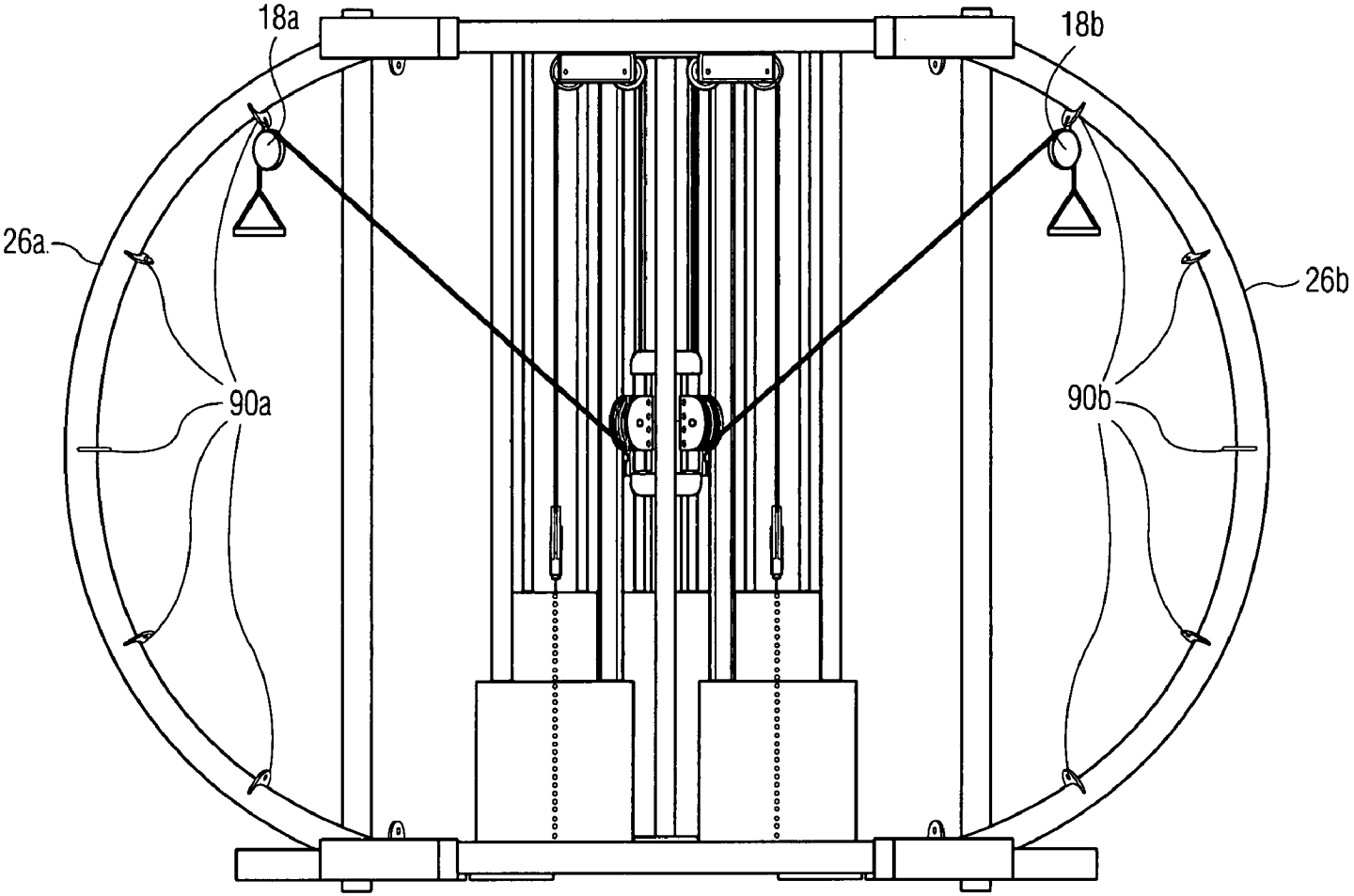
FIG. 12 is a front view of exercise apparatus according to a fifth preferred embodiment of the present invention.

FIG. 12 illustrates a fifth embodiment, similar to the embodiment of FIGS. 10 and 11, wherein the pulleys 20*a* and 20*b* are removably attached to one of a plurality of fittings 90*a* and 90*b* on the frame members 26*a*, 26*b*, respectively.

There has thus been shown and described a novel exercise apparatus which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Exercise apparatus comprising, in combination:

(a) a first arcuate frame member forming a segment of an approximate circle having a center, the circle and its center defining an imaginary plane;

(b) frame support for supporting the frame member in a upright position such that the plane is substantially vertically oriented;

(c) a first cable pulley adapted to be attached to the frame member at one of a plurality of positions along its arc;

(d) a second cable pulley fixedly mounted in the vicinity of a substantially horizontal, imaginary first axis that extends perpendicular to the plane and passes through the approximate center of the circle;

(e) at least one source of resistance;

(f) a first handle adapted to be grasped by a user; and (g) a first flexible cable having a proximate end attached to said first handle and a distal end coupled to said at least one resistance source, the cable passing through both the first pulley and the second pulley, whereby the length of the first cable remains substantially constant when said first pulley is repositioned from one location along the arc of the first frame member to another.

2. Exercise apparatus according to claim 1, further comprising:

(h) a second arcuate frame member forming a second segment of said approximate circle, said frame support supporting the second frame member in a upright position;

(j) a third cable pulley adapted to be attached to the second frame member at one of a plurality of positions along its arc;

(k) a fourth cable pulley fixedly mounted in the vicinity of said imaginary first axis;

(l) a second handle adapted to be grasped by a user; and (m) a second flexible cable having a proximate end attached to said handle and a distal end coupled to said at least one resistance source, the cable passing through both the third pulley and the fourth pulley, whereby the length of the second cable remains substantially constant when said second pulley is repositioned from one location along the arc of the second frame member to another.

3. Exercise apparatus according to claim 1, further comprising a first arcuate track mounted on said first frame member and a first trolley mounted for movement along said first track and positionable at a plurality of locations along said first track, said first cable pulley being mounted on said first trolley and movable with said first trolley along said first track.

4. Exercise apparatus according to claim 2, further comprising a second arcuate track mounted on said second frame member and a second trolley mounted for movement along said second track and positionable at a plurality of locations along said second track, said third cable pulley being mounted on said second trolley and movable with said second trolley along said second track.

5. Exercise apparatus according to claim 1, further comprising a plurality of fittings, mounted in spaced relation along said first frame member, adapted for attachment of said first pulley to said first frame member at one of a plurality of positions thereon selected by the user.

6. Exercise apparatus according to claim 2, further comprising a plurality of fittings, mounted in spaced relation along said second frame member, adapted for attachment of said third pulley to said second frame member at one of a plurality of positions thereon selected by the user.

7. Exercise apparatus according to claim 1, wherein said resistance source is selected from the group consisting of a weight stack, at least one spring and at least one damper.

8. Exercise apparatus according to claim 2, wherein said resistance source is selected from the group consisting of a weight stack, at least one spring and at least one damper.

9. Exercise apparatus according to claim 2, wherein each of said first cable and said second cable is attached, at its distal end, to a separate resistance source.

10. Exercise apparatus according to claim 2, wherein the distal ends of said first and second cables are connected together and to a common resistance source.

11. Exercise apparatus according to claim 10, further comprising a fifth cable pulley attached to said common resistance source, said distal ends of said first and second cables passing through said fifth pulley.

12. Exercise apparatus according to claim 3, further comprising means for locking said first trolley at a selected one of said plurality of locations along said first track.

13. Exercise apparatus according to claim 12, wherein said first track includes a plurality of recesses disposed along said first track, and wherein said locking means includes detent means, disposed on said first trolley, for insertion in said recesses along said track.

14. Exercise apparatus according to claim 13, wherein said locking means includes mechanical means for biasing said detent means toward said recesses.

15. Exercise apparatus according to claim 14, wherein said locking means includes a third handle for withdrawing said detent means from one of said recesses.

16. Exercise apparatus according to claim 1, wherein said second pulley is mounted on a gimbal that permits the second pulley to self-align itself with the cable as the first pulley is moved to different positions along the first frame member.

17. Exercise apparatus according to claim 2, wherein said second pulley and said fourth pulley are mounted adjacent each other, and wherein said second pulley and said fourth pulley are each mounted on a gimbal that permits the respective pulley to self-align itself with the first and second cable, respectively, as one of the first pulley and third pulley is moved to different positions along the first frame member and second frame member, respectively.

18. Exercise apparatus according to claim 2, wherein said first and second arcuate frame members are hinged at their ends such that they may be positioned and locked in a plurality of positions with respect to each other.

19. Exercise apparatus according to claim 18, wherein said first frame member and said second frame member are movable between a first position, wherein said first and second frame members form parts of an approximate, common circle, and a second position wherein said first and second frame members are spaced further apart from each other, thereby allowing a user to stand in a space between them.

20. Exercise apparatus according to claim 3, wherein said trolley comprises at least one trolley wheel arranged to travel is said track and wherein said track comprises top and bottom portions for supporting opposite sides of said trolley wheel.

21. Exercise apparatus according to claim 20, wherein said trolley comprises a set of two trolley wheels arranged in spaced apart relationship on a common axle, and wherein top portion of said track comprises a tube having an external diameter which is greater than the distance between said two wheels.

22. Exercise apparatus according to claim 21, wherein said trolley comprises two sets of trolley wheels, each set having two trolley wheels arranged in spaced apart relationship on a common axle.

23. Exercise apparatus according to claim 1, further comprising:

(h) a third cable pulley adapted to be attached to the frame member at one of a plurality of positions along its arc;

(i) a fourth cable pulley fixedly mounted in the vicinity of the second cable pulley;

(j) a second handle adapted to be grasped by a user;

wherein the flexible cable has a first section coupled at a proximate end to said first handle and at a distal end to said at least one resistance source, the first section of the cable passing through both the first pulley and the second pulley between said first handle and said resistance source; and wherein the flexible cable has a second section coupled at a proximate end to said second handle and at a distal end to said at least one resistance source, the second section of the cable passing through both the third pulley and the fourth pulley between said second handle and said resistance source.

24. Exercise apparatus according to claim 23, wherein said distal ends of said first section and said second section of the flexible cable are joined and contiguous with each other.

25. Exercise apparatus according to claim 2, wherein said frame support supports said first arcuate frame member and said second arcuate frame member in an upright position in spaced apart relationship with a gap in at least a lowermost portion of said approximate circle, thereby to allow a user to stand in the space between the frame members.

* * * * *